US011104568B2

(12) United States Patent
Gulati et al.

(10) Patent No.: US 11,104,568 B2
(45) Date of Patent: Aug. 31, 2021

(54) NON-ELECTRIC FOUNTAIN BEVERAGE DISPENSERS AND SYSTEMS

(71) Applicant: PepsiCo, Inc., Purchase, NY (US)

(72) Inventors: Amandeep Singh Gulati, New Delhi (IN); Gurmeet Singh Bhutani, Gurgaon (IN); Rahul Sadashiv Kamble, Faridabad (IN)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 16/703,549

(22) Filed: Dec. 4, 2019

(65) Prior Publication Data

US 2020/0180932 A1 Jun. 11, 2020

(30) Foreign Application Priority Data

Dec. 5, 2018 (IN) ..... 201841045924

(51) Int. Cl.
*B67D 1/04* (2006.01)
*B67D 1/00* (2006.01)
(Continued)

(52) U.S. Cl.
CPC ..... *B67D 1/0406* (2013.01); *B67D 1/0021* (2013.01); *B67D 1/0043* (2013.01);
(Continued)

(58) Field of Classification Search
CPC .. B67D 1/0406; B67D 1/0021; B67D 1/0069; B67D 1/0043; B67D 1/0082; B67D 1/16;
(Continued)

(56) References Cited

U.S. PATENT DOCUMENTS 4,781,309 A 11/1988 Vogel
7,267,247 B1 9/2007 Crunkleton, III et al.
(Continued)

FOREIGN PATENT DOCUMENTS

EP 1211217 A1 6/2002

OTHER PUBLICATIONS

International Search Report and Written Opinion in PCT/US2019/064497 dated Feb. 6, 2020 (9 pages).
(Continued)

*Primary Examiner* — Donnell A Long
(74) *Attorney, Agent, or Firm* — Sterne, Kessler, Goldstein & Fox P.L.L.C.

(57) ABSTRACT

Non-electric fountain beverage dispensers for dispensing a variety of beverages without the use of electricity. The non-electric fountain beverage dispenser may include a gas container for storing a pressurized gas, a base liquid storage container for storing a base liquid, and a gas supply line that communicates pressurized gas from the gas container to the base liquid storage container and to a syrup storage container. Non-electric beverage dispenser further includes a mechanical dispensing valve in fluid communication with the base liquid storage container and the syrup storage container by means of a base liquid supply line and a syrup supply line, respectively, such that the mechanical dispensing valve is capable of selectively dispensing a mixture of the base liquid and the syrup. Non-electric fountain beverage dispenser further includes a non-electric cooling unit for cooling the base liquid without the use of electricity.

20 Claims, 10 Drawing Sheets

(51) Int. Cl.
*B67D 1/16* (2006.01)
*B67D 1/08* (2006.01)

(52) U.S. Cl.
CPC ..... *B67D 1/0069* (2013.01); *B67D 1/0082* (2013.01); *B67D 1/0857* (2013.01); *B67D 1/16* (2013.01); *B67D 2001/0098* (2013.01); *B67D 2210/00031* (2013.01); *B67D 2210/00104* (2013.01); *B67D 2210/00133* (2013.01)

(58) Field of Classification Search
CPC ..... B67D 1/0857; B67D 2210/00133; B67D 2001/0098; B67D 2210/00031; B67D 2210/00104; B67D 1/0009; B67D 1/1222; B67D 2001/0828; B67D 1/004; B67D 2001/0092; B67D 2210/0001
USPC ..... 222/146.6
See application file for complete search history.

(56) References Cited

U.S. PATENT DOCUMENTS

| | | | | |
|---|---|---|---|---|
| 9,873,606 | B2 | 1/2018 | Nachawati et al. | |
| 2006/0231574 | A1 | 10/2006 | Bilskie et al. | |
| 2009/0236361 | A1* | 9/2009 | Doelman | B65D 47/242 222/1 |
| 2012/0042682 | A1* | 2/2012 | Cominski | B67D 1/0859 62/389 |
| 2012/0138635 | A1* | 6/2012 | Norris | B67D 3/0038 222/131 |
| 2013/0206792 | A1* | 8/2013 | Schroeder | B67D 1/0021 222/129.1 |
| 2013/0277394 | A1* | 10/2013 | Edwards | B67D 1/0892 222/144.5 |
| 2014/0263400 | A1* | 9/2014 | Kuehl | B67D 1/0861 222/1 |
| 2014/0319175 | A1* | 10/2014 | Tobler | F25D 31/002 222/108 |
| 2017/0050836 | A1* | 2/2017 | Yoon | B67D 1/0864 |
| 2017/0101301 | A1* | 4/2017 | Volin | F25D 3/06 |
| 2017/0362072 | A1* | 12/2017 | Garcia | B67D 1/06 |
| 2018/0002153 | A1* | 1/2018 | Kim | B67D 1/0888 |
| 2018/0057341 | A1* | 3/2018 | Kincaid | H02H 9/046 |
| 2018/0057343 | A1* | 3/2018 | Bhutani | B67D 1/0044 |
| 2019/0256337 | A1* | 8/2019 | Bhutani | B67D 1/0406 |
| 2019/0276299 | A1* | 9/2019 | Park | C02F 1/001 |
| 2019/0330041 | A1* | 10/2019 | Fire | B67D 1/0086 |
| 2020/0216331 | A1* | 7/2020 | Jeon | C02F 1/003 |
| 2020/0247654 | A1* | 8/2020 | McIntyre | B67D 1/0437 |

OTHER PUBLICATIONS

Rapids Wholesale Equipment. Cold Plate Coolers vs Coil Coolers | Rapids Jockey Boxes Tutorial. YouTube. Jul. 17, 2017. [retrieved on Jan. 22, 2020]. Retrieved from Internet: <https://www.youtube.com/watch?v=xa60QBMKCpw>. entire video.

* cited by examiner

NON-ELECTRIC FOUNTAIN BEVERAGE DISPENSERS AND SYSTEMS

FIELD

Embodiments described herein generally relate to devices for dispensing fountain beverages. Specifically, embodiments described herein relate to fountain beverage dispensers that do not include electrical components and which do not use electricity.

BACKGROUND

Fountain beverage dispensers are commonly used to provide consumers with the ability to quickly and easily select and dispense a desired beverage from a variety of available beverage options. However, conventional fountain beverage dispensers generally rely on electricity for carrying out the dispensing operation. As a result, such conventional fountain beverage dispensers may be expensive to manufacture and operate. Additionally, such conventional fountain beverage dispensers are not suitable for use in areas that lack an electrical grid or that otherwise have limited or no access to electricity, such as rural, remote, or underdeveloped areas. Due to the reliance on electricity, conventional beverage dispensers have limited portability and are often mounted permanently or semi-permanently in a fixed location in a store, restaurant, movie theater, or the like.

Therefore, a continuing need exists for fountain beverage dispensers that are capable of dispensing a beverage without the use of electricity.

BRIEF SUMMARY OF THE INVENTION

Some embodiments are directed to a non-electric, fountain beverage dispenser that includes a gas container configured to store a pressurized gas; a base liquid storage container configured to store a base liquid; a gas supply line in fluid communication with the gas container, wherein the gas supply line communicates the pressurized gas from the gas container to the base liquid storage container, and wherein the gas supply line is configured to communicate the pressurized gas from the gas container to a syrup storage container containing a syrup; a base liquid supply line having a first terminal end in fluid communication with the base liquid storage container, and a second terminal end; a syrup supply line having a first terminal end in fluid communication with the syrup storage container, and a second terminal end; a non-electric cooling unit configured to cool the base liquid without the use of electricity; and a mechanical dispensing valve in fluid communication with the second terminal end of the base liquid supply line and the second terminal end of the syrup supply line such that the mechanical dispensing valve is capable of selectively dispensing a mixture of the base liquid and the syrup.

Some embodiments are directed to a non-electric fountain beverage dispenser that includes a gas container configured to store a pressurized gas; a housing containing a base liquid storage container configured to store a base liquid, and a non-electric cooling unit configured to cool the base liquid; wherein the gas container is in fluid communication with the base liquid storage container so as to supply the pressurized gas to the base liquid storage container for driving a flow of the base liquid, and wherein the gas container is configured to be placed in fluid communication with a syrup storage container so as to supply the pressurized gas to the syrup storage container for driving a flow of the syrup; and a mechanical dispensing valve in fluid communication with the base liquid storage container and the syrup storage container such that the mechanical dispensing valve is configured to selectively dispense a mixture of the base liquid and the syrup.

Some embodiments are directed to a beverage dispensing system that includes a non-electric fountain beverage dispenser having a gas container configured to store a pressurized gas; a base liquid storage container configured to store a base liquid; a gas supply line in fluid communication with the gas container, wherein the gas supply line communicates the pressurized gas from the gas container to the base liquid storage container, and wherein the gas supply line is configured to communicate the pressurized gas from the gas container to a syrup storage container containing a syrup; a base liquid supply line having a first terminal end in fluid communication with the base liquid storage container, and a second terminal end; a syrup supply line having a first terminal end configured to be placed in fluid communication with the syrup storage container, and a second terminal end; a non-electric cooling unit configured to cool the base liquid without the use of electricity; and a mechanical dispensing valve connected to the second terminal end of the base liquid supply line and the second terminal end of the syrup supply line such that the mechanical dispensing valve is capable of selectively dispensing a mixture of the base liquid and the syrup; and a movable cart having a frame with a support surface on which the non-electric fountain beverage dispenser is positioned, and a storage compartment configured to store the syrup storage container.

In any of the various embodiments discussed herein, the pressurized gas may be carbon dioxide. In some embodiments, the base liquid within the base liquid storage container may be carbonated by the carbon dioxide supplied to the base liquid storage container via the gas supply line.

In any of the various embodiments discussed herein, the gas container may have a pressure regulator configured to regulate a pressure of the pressurized gas supplied to the base liquid storage container. In some embodiments, the non-electric fountain beverage dispenser may have a secondary pressure regulator configured to regulate a pressure of the pressurized gas supplied to the syrup storage container.

In any of the various embodiments discussed herein, the non-electric fountain beverage dispenser may further include a water purifier in fluid communication with the base liquid storage container.

In any of the various embodiments discussed herein, the non-electric fountain beverage dispenser may include a secondary base liquid storage container, wherein the secondary base liquid storage container is configured to store a second base liquid.

In any of the various embodiments discussed herein, the non-electric cooling unit of the non-electric fountain beverage dispenser may include an insulated container having an interior volume configured to store ice, and wherein the base liquid supply line extends through the interior volume of the insulated container. In some embodiments, a portion of the base liquid supply line that extends through the insulated container may be coiled. In some embodiments, the non-electric cooling unit may be further configured to cool syrup in the syrup supply line.

In any of the various embodiments discussed herein, the non-electric cooling unit may include an insulated container having an interior volume configured to store ice, and a cold plate disposed within the interior volume of the insulated container and which is in fluid communication with the base liquid supply line.

In any of the various embodiments discussed herein, the syrup supply line may be one of a plurality of syrup supply lines, and the mechanical dispensing valve may be one of a plurality of mechanical dispensing valves, and each of the plurality of syrup supply lines has a first terminal end in fluid communication with a syrup storage container and a second terminal end in fluid communication with a mechanical dispensing valve of the plurality of mechanical dispensing valves.

In any of the various embodiments discussed herein, the mechanical dispensing valve may be one of a plurality of mechanical dispensing valves, and the base liquid supply line may include a manifold configured to direct the base liquid to the plurality of mechanical dispensing valves.

In any of the various embodiments discussed herein, the mechanical dispensing valve of the non-electric fountain beverage dispenser may include a mechanical actuator that, when actuated, causes the mechanical dispensing valve to dispense the mixture of the base liquid and the syrup.

In any of the various embodiments discussed herein, the non-electric fountain beverage dispenser may include a base liquid supply line for communicating the base liquid from the base liquid storage container to the mechanical dispensing valve, wherein the base liquid supply line is contained within the housing. In some embodiments, the mechanical dispensing valve is mounted on an exterior surface of the housing so as to define a beverage dispensing area beneath the mechanical dispensing valve. In some embodiments, the non-electric fountain beverage dispenser further includes a drip tray connected to the housing and positioned in the beverage dispensing area beneath the mechanical dispensing valve.

In any of the various embodiments discussed herein which include a movable cart, the movable cart may include a plurality of wheels.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION OF THE INVENTION

Figure 1:
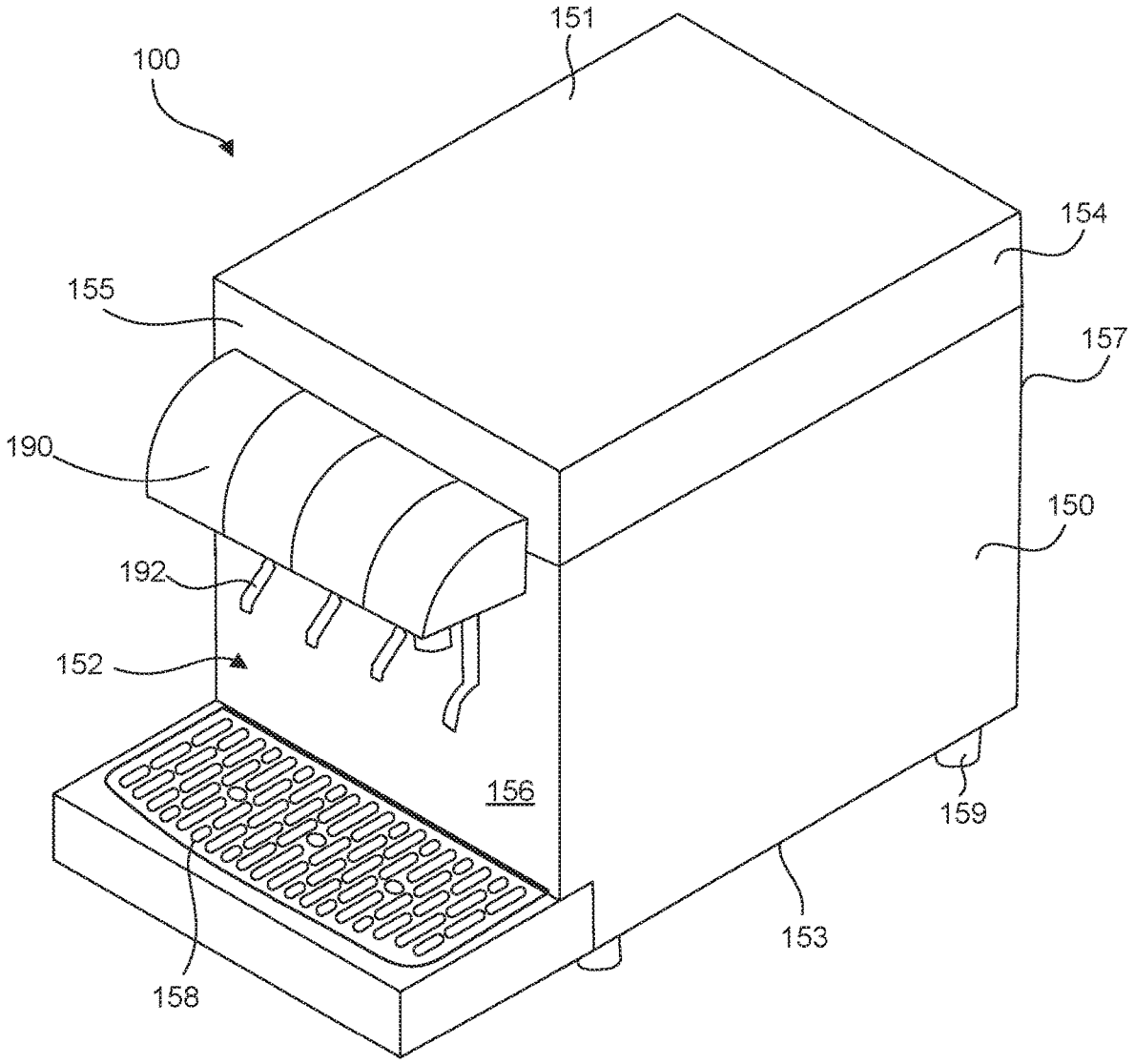
FIG. 1 shows a perspective view of a non-electric fountain beverage dispenser according to some embodiments.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

Conventional fountain beverage dispensers rely on electricity for dispensing beverages. Such conventional beverage dispensers rely on electrical pumps for driving fluid flow within the beverage dispenser. Additionally, conventional beverage dispensers may include carbonators that utilize electricity to produce carbonated water within the dispenser. Further, the cooling or refrigeration system of a conventional beverage dispenser generally requires electricity. Dispensing valves for dispensing a beverage may also include electronic components or may be electromechanical valves. While the use of electricity to power the various components of a beverage dispenser may be convenient in some cases, beverage dispensers which require electricity to operate have a number of drawbacks.

Beverage dispensers incorporating electrical or electromechanical components may be expensive to manufacture and operate. The various electrical components used in a beverage dispenser may be expensive to manufacture, such as electrical pumps and refrigeration systems, and the use of these components may increase the capital cost of manufacturing the beverage dispenser. The electrical components, particularly the refrigeration system, may also draw a considerable amount of electricity when in use which can increase the cost of operating the beverage dispenser. The capital and operating costs of conventional beverage dispensers may be prohibitively expensive for many consumers.

Further, the various electrical components may require repair, maintenance, and service in order to keep the beverage dispensing system operational. If any of the components fail to work, the beverage dispenser may be inoperable until repaired. The inability to use the beverage dispenser may be inconvenient for the owner of the beverage dispenser and can result in a loss of profits stemming from the use of the beverage dispenser to sell beverages to customers. Repairing and maintaining the beverage dispenser is an additional cost of owning and operating the beverage dispenser.

Additionally, conventional beverage dispensers that rely on electricity have limited portability resulting from the need to be connected to an electrical power source. Beverage dispensers having electrical components cannot be used in areas lacking an electrical grid or otherwise having limited or no access to electricity, such as in rural, remote, or underdeveloped areas. Even in urban or developed areas, electronic beverage dispensers cannot readily be used in many areas that lack a source of electricity, such in outdoor areas, including beaches, parks, playgrounds, campgrounds, and parking lots, and at outdoor events including picnics, baseball games and other sporting events, tailgates, carnivals, block parties, and festivals, among others.

In some embodiments as described herein, a non-electric fountain beverage dispenser dispenses beverages to consumers without the use of electricity. Eliminating electrical components helps to reduce the cost of manufacturing and operating the beverage dispenser. Additionally, the use of a non-electric beverage dispenser improves the portability of the beverage dispenser, and allows the beverage dispenser to be brought to areas having potential customers, as the dispenser does not have to be located near a source of electricity.

As used herein, the term "non-electric" refers to systems or components that do not include electrical or electromechanical components and which do not use or require electrical energy to operate. Accordingly, such "non-electric" systems and components can operate independently of a source of electrical energy, such as a power grid, an electrical generator, or a battery.

In some embodiments, a non-electric fountain beverage dispenser 100 includes a gas container 120 for storing a pressurized gas used to drive fluid flow, and a base liquid storage container 170 for storing a base liquid that is in communication with gas container 120. A syrup storage container 640 containing a syrup may also be placed in fluid communication with gas container 120. A mechanical dispensing valve 190 is in fluid communication with base liquid storage container 170 and may be placed in fluid communication with syrup storage container 640. Mechanical dispensing valve 190 is configured to dispense a mixture of the base liquid and the syrup upon actuation of a mechanical actuator 192. In some embodiments, mechanical dispensing valve 190 may be configured to selectively dispense the base liquid alone, i.e., without a syrup, if desired. Additionally, non-electric fountain beverage dispenser 100 includes a non-electric cooling unit 160 for cooling the base liquid and optionally the syrup such that the beverage dispensed by mechanical dispensing valve 190 is cooled or chilled.

With reference to FIG. 1, a non-electric beverage dispenser 100 is configured to provide a beverage to a consumer without the use of electricity. Non-electric fountain beverage dispenser 100 may be used to dispense any of various types of beverages. As used herein, the term "beverage" includes any consumable free-flowing liquid or semi-liquid product, which may be carbonated or non-carbonated, including, but not limited to, soft drinks, water, carbonated water, dairy beverages, juices, alcoholic beverages, sports drinks, smoothies, coffee beverages, tea beverages, and milkshakes.

Figure 2:
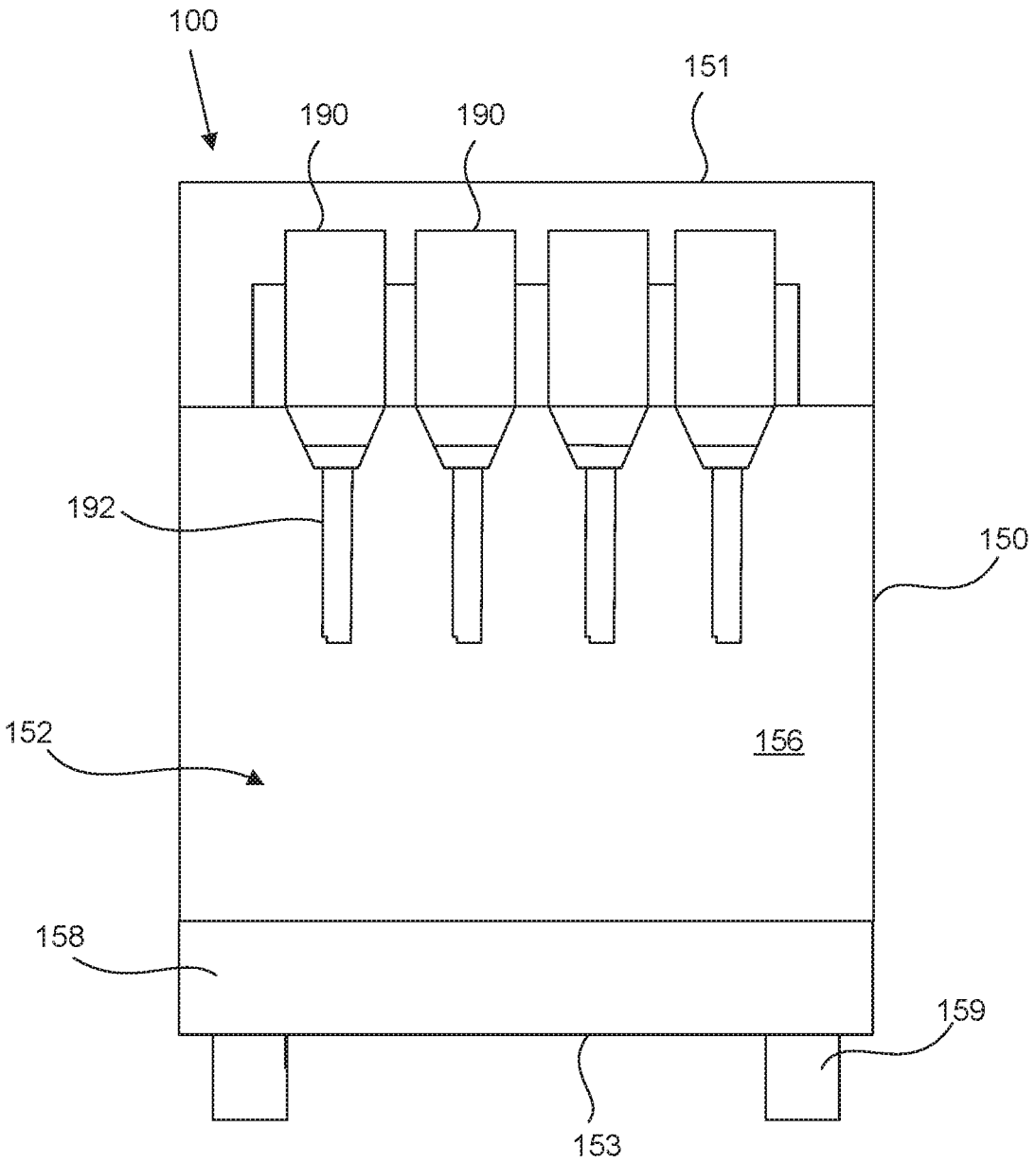
FIG. 2 shows a front view of a non-electric fountain beverage dispenser according to some embodiments.
Figure 3:
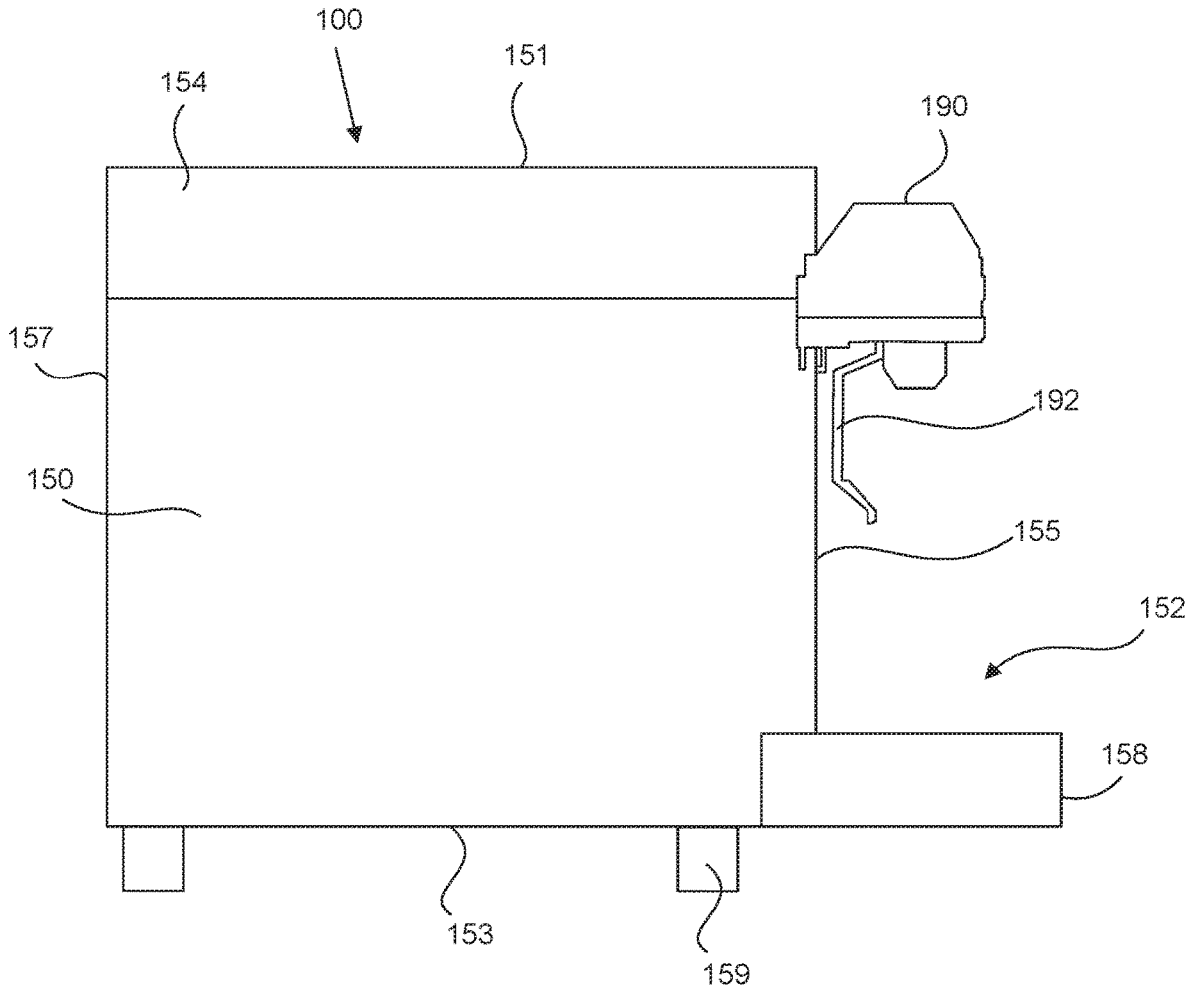
FIG. 3 shows a side view of a non-electric fountain beverage dispenser according to some embodiments.

As shown in FIGS. 1-3, non-electric fountain beverage dispenser 100 includes a housing 150 that contains and/or arranges components of non-electric fountain beverage dispenser 100. Housing 150 includes a lower end 153 opposite an upper end 151, and a front portion 155 opposite a rear portion 157. Housing 150 may have any of various configurations, and is shown in FIGS. 1-3 as being shaped substantially as a cube or rectangular prism. In some embodiments, housing 150 may have other shapes, such as a cylindrical shape or a hemi-cylindrical shape, among others, or may have a front portion 155 that is rounded or curvilinear to provide a desired appearance. Further, housing 150 may be composed of any of various materials, including but not limited to wood, ceramics, metals, such as aluminum or stainless steel, or hard plastic materials, such as acrylonitrile butadiene styrene (ABS), polycarbonate, polymethyl methacrylate (PMMA), and blends or combinations thereof, among other materials.

Non-electric beverage dispenser 100 does not include electrical components and does not require electrical energy to operate. Accordingly, non-electric beverage dispenser 100 can be transported to a desired location for use. Non-electric beverage dispenser 100 may be mounted on a support surface, such as a countertop, table, or cart. Alternatively, non-electric beverage dispenser 100 may include an integrally formed or modular support structure such that the beverage dispenser 100 can function as a stand-alone device.

In some embodiments, housing 150 may include a plurality of feet 159 on lower end 153 for engaging a support surface. Feet 159 serve to stably position non-electric fountain beverage dispenser 100 in a desired location on a support surface and help to prevent beverage dispenser 100 from sliding or otherwise moving on the support surface.

Housing 150 of non-electric fountain beverage dispenser 100 contains one or more components of fountain beverage dispenser 100. Housing 150 arranges and protects components of the beverage dispenser 100 and provides a desired aesthetic appearance. In some embodiments, a lid 154 is positioned at upper end 151 of housing 150. Lid 154 may be selectively moved from a closed configuration in which an interior volume of housing 150 is inaccessible, and an open configuration in which the interior volume of housing 150 and components located therein are accessible. Accessing the interior volume of housing 150 and components therein may be necessary for repair, maintenance, or service of non-electric fountain beverage dispenser 100. Lid 154 may be fully removable from housing 150 or may be partially removable. In embodiments in which lid 154 is partially removable, lid 154 may be pivotally connected to housing 150 by one or more hinges arranged on an edge of lid 154, or may be in a sliding connection with housing 150.

Mechanical dispensing valves 190 are mounted on an exterior surface 156 of housing 150. Mechanical dispensing valves 190 may be arranged at front portion 155 of housing 150. Mechanical dispensing valves 190 are mounted towards upper end 151 of housing 150 so as to define a beverage dispensing area 152 beneath mechanical dispensing valves 190. A cup or other container may be placed in beverage dispensing area 152 for collecting a beverage dispensed from mechanical dispensing valves 190.

In some embodiments, housing 150 further includes a drip tray 158. Drip tray 158 is permanently or removably connected to housing 150. Drip tray 158 is connected to housing 150 towards lower end 153 of housing 150. Drip tray 158 is positioned beneath mechanical dispensing valves 190 at front portion 155 of housing 150 in beverage dispensing area 152. In this way, drip tray 158 is configured to collect excess liquid dispensed from mechanical dispensing valves 190. Drip tray 158 may be configured to hold the excess liquid until the drip tray 158 is manually emptied, such as by removing and inverting drip tray 158 to cause collected fluid to spill therefrom. Alternatively, drip tray 158 may have a drain that allows the liquid to flow to a waste storage container, a sewage treatment system, or the like.

Figure 4:
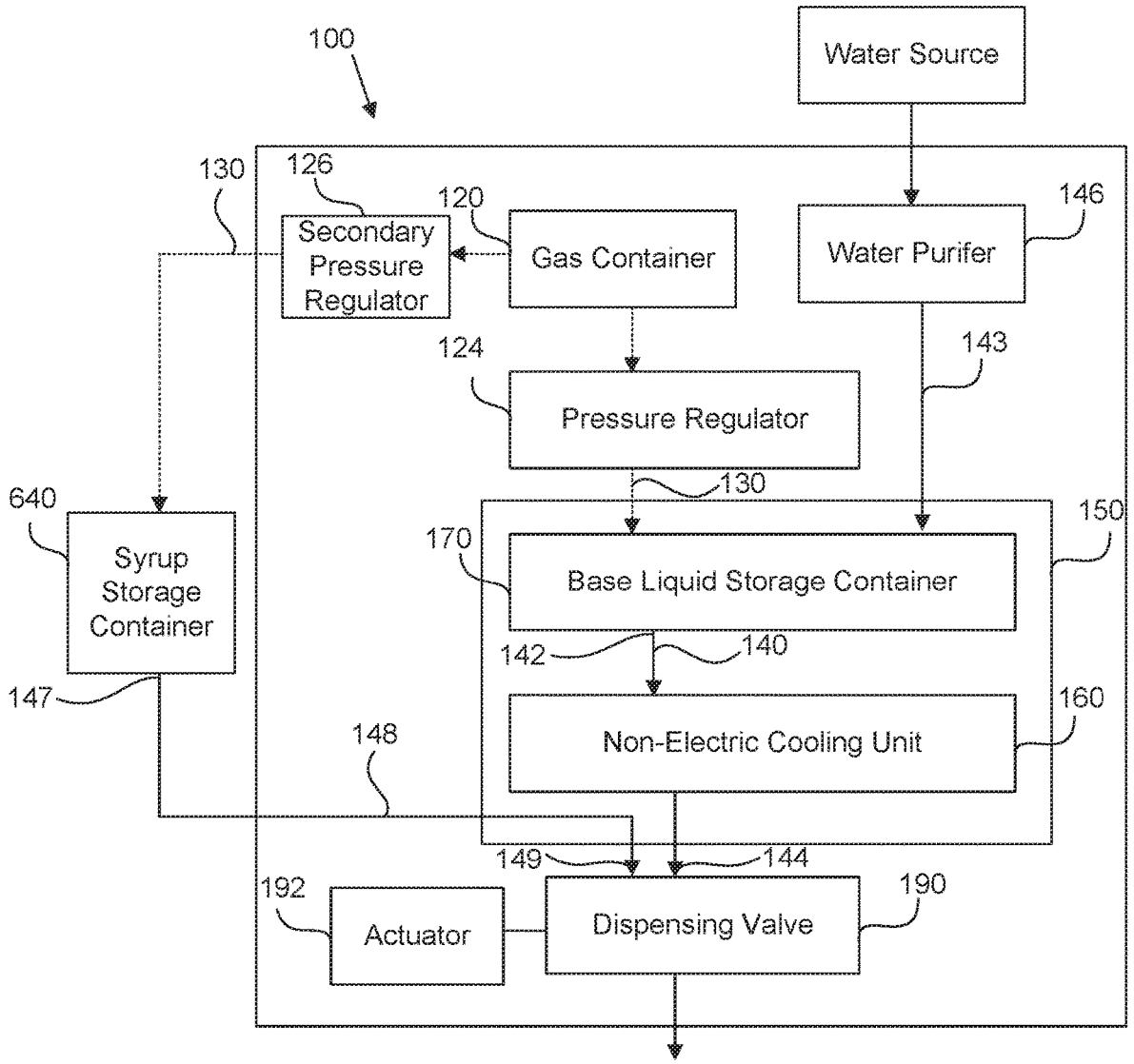
FIG. 4 shows a schematic block diagram of the components of a non-electric fountain beverage dispenser according to some embodiments.

In some embodiments, non-electric fountain beverage dispenser 100 includes a gas container 120 as shown for example at FIG. 4. Gas container 120 is configured to store a pressurized gas. The pressurized gas may be compressed air, nitrogen, or carbon dioxide, among others. The pressurized gas supplied by gas container 120 is used to drive fluid flow within fountain beverage dispenser 100. Thus, both the base liquid and the syrup are supplied to mechanical dispensing valve 190 by means of the pressure provided by the pressurized gas. As a result, non-electric fountain beverage dispenser 100 does not require the use of electrical pumps, as are commonly used in conventional fountain beverage dispensers, for driving fluid flow and dispensing a beverage.

Non-electric beverage dispenser 100 further includes a base liquid storage container 170 for storing a base liquid to be dispensing by a mechanical dispensing valve 190 of beverage dispenser 100. As used herein, the term "base liquid," refers to any liquid that may be consumed as a beverage, with or without the addition of a syrup or other flavorings. For example, when the fountain beverage dispenser 100 is used to dispense different types of soft drinks, the base liquid may be without limitation, water or carbonated water.

Base liquid storage container 170 may be positioned within or at least partially within housing 150. Base liquid storage container 170 may be removable from housing 150 to facilitate filling of base liquid storage container 170 or base liquid storage container 170 may be permanently positioned within housing 150. In embodiments in which base liquid storage container 170 is positioned within housing 150, base liquid storage container 170 may be accessible by moving lid 154 into an open configuration. Base liquid storage container 170 may be filled with a base liquid for operation of fountain beverage dispenser 100. Alternatively, in some embodiments, base liquid storage container 170 may be in communication with a water source (or other liquid source), such that base liquid storage container 170 can be selectively filled with water from the water source.

In some embodiments, base liquid storage container 170 may be in fluid communication with a water purifier 146. Base liquid storage container 170 may be in fluid communication with water purifier 146 by means of one or more conduits 143. Water purifier 146 may be used to purify water, such as water supplied from a water source, prior to the water entering base liquid storage container 170. In embodiments in which the water is supplied from a water source, water purifier 146 may be connected to the water source, such as by means of a conduit, and water purifier 146 is in turn connected to base liquid storage container 170 to supply purified water thereto. In some embodiments, water purifier 146 is non-electric and thus does not require electricity and does not have electrical components. Water purifier 146 may include an activated carbon filter, a reverse osmosis filter, a membrane filter, or a combination thereof, among other types of water purification and filtration devices. For example, water purifier 146 may cause water to flow over a bed of activated carbon particles to remove contaminants, or the water purifier 146 may include a porous membrane through which water may pass and which is configured to remove contaminants from the water.

Base liquid storage container 170 is in fluid communication with gas container 120 such that the pressurized gas in gas container 120 is supplied to base liquid storage container 170 for driving the flow of the base liquid from base liquid storage container 170. Base liquid storage container 170 may be in fluid communication with gas container 120 via a gas supply line 130. Gas supply line 130 may include a flexible or rigid hose or conduit. A first end of the gas supply line 130 is in fluid communication with gas container 120 and a second end is in fluid communication with base liquid storage container 170. Non-electric fountain beverage dispenser 100 may include a pressure regulator 124 for regulating a pressure of the pressurized gas supplied to base liquid storage container 170. Pressure regulator 124 may include an adjustment knob configured to allow a user to selectively adjust a pressure of the pressurized gas supplied from gas container 120. Base liquid storage container 170 is maintained at a sufficient pressure to drive the base liquid from base liquid storage container 170 to a mechanical dispensing valve 190 for dispensing the base liquid. In some embodiments, base liquid storage container 170 is maintained at a pressure of about 50 psi to about 70 psi. The pressure within base liquid storage container 170 can be adjusted using pressure regulator 124 to provide sufficient flow of the base liquid to mechanical dispensing valves 190.

Non-electric fountain beverage dispenser 100 is also configured for use with a syrup storage container 640 containing a syrup to be dispensed by mechanical dispensing valve 190. As used herein, the term "syrup," may refer to any sweetener, flavoring, or concentrate to be mixed with a base liquid to prepare a flavored beverage. The syrup may be used, for example, to prepare a particular type or style of soda, such as a cola or a lemon-lime soda. Syrup storage container 640 containing a syrup for use with non-electric fountain beverage dispenser 100 may be commercially available and can be obtained from a manufacturer or supplier of such products. Syrup storage container 640 may be removed and replaced as needed, such as when the syrup is depleted or when it is desired to utilize a different type or flavor of syrup.

Gas container 120 may be placed in fluid communication with syrup storage container 640 for driving flow of syrup to mechanical dispensing valve 190. A gas supply line 130 may be used to place gas container 120 in fluid communication with syrup storage container 640. A first end of gas supply line 130 may be placed in fluid communication with gas container 120 and a second end of gas supply line 130 may be placed in fluid communication with syrup storage container 640. A secondary pressure regulator 126 may be provided to regulate a pressure of the pressurized gas supplied to the syrup storage container 640. Secondary pressure regulator 126 may include an adjustment knob configured to allow a user to selectively adjust a pressure of the pressurized gas supplied from gas container 120. The syrup storage container 640 is maintained at a pressure sufficient to allow syrup to flow to mechanical dispensing valve 190.

The pressure of the pressurized gas supplied to base liquid storage container 170 and syrup storage container 640 determines the flow of the base liquid and the syrup. Thus, to achieve a desired ratio of base liquid to syrup in the dispensed mixture, the pressure supplied to base liquid storage container 170 and to syrup storage container 640 can be adjusted by means of pressure regulator 124 and secondary pressure regulator 126.

In some embodiments, non-electric fountain beverage dispenser 100 includes a single gas supply line 130 that is branched so that it includes multiple second ends and can supply pressurized gas to both base liquid storage container 170 and syrup storage container 640. Alternatively, gas supply line 130 may include a fitting, such as a tee ("T") fitting, so as to direct pressurized gas into multiple secondary gas supply lines, wherein the secondary gas supply lines direct pressurized gas from gas container 120 to base liquid storage container 170 and syrup storage container 640. In alternate embodiments, non-electric fountain beverage dispenser 100 may include multiple gas supply lines 130, wherein a first gas supply line 130 is used to supply pressurized gas from gas container 120 to base liquid storage container 170, and a second gas supply line 130 is used to supply pressurized gas from gas container 120 to syrup storage container 640. One of ordinary skill in the art will appreciate that there are various configurations for placing gas container 120 in fluid communication with base liquid storage container 170 and syrup storage container 640 in order to supply a pressurized gas to base liquid storage container 170 and syrup storage container 640.

Non-electric fountain beverage dispenser 100 further includes a mechanical dispensing valve 190 in fluid communication with each of base liquid storage container 170 and syrup storage container 640 such that mechanical dispensing valve 190 is configured to selectively dispense a mixture of the base liquid and the syrup, i.e., a beverage. Mechanical dispensing valve 190 may be capable of dispensing a beverage without the use of electricity or electrical components, such as a circuit board, solenoid, or other electrical components commonly incorporated in electrical dispensing valves. In some embodiments, mechanical dispensing valve 190 is a post-mix valve, and such valves are commercially available, for example, as manufactured by Lancer® or Cornelius®, among others. Mechanical dispensing valve 190 may include a mechanical actuator 192 for actuating the mechanical dispensing valve 190 so as to selectively dispense a beverage. Manual actuation of mechanical actuator 192 causes mechanical dispensing valve 190 to open so that a beverage may be selectively dispensed through mechanical dispensing valve 190 without the use of electricity. For example, manual actuation of mechanical actuator 192 may cause a gate or other flow-impeding element of mechanical dispensing valve 190 to move so as to allow a beverage to pass through mechanical dispensing valve 190. Mechanical actuator 192 may include a lever, switch, or button, among other non-electric actuating mechanisms.

A base liquid supply line 140 may be used to communicate the base liquid from base liquid storage container 170 to mechanical dispensing valve 190. A first terminal end 142 of base liquid supply line 140 is in fluid communication with base liquid storage container 170. Specifically, first terminal end 142 may be inserted into base liquid storage container 170 such that it is submerged in the base liquid therein. A second terminal end 144 of base liquid supply line 140 is in fluid communication with mechanical dispensing valve 190.

Similarly, a syrup supply line 148 may be used to communicate syrup from a syrup storage container 640 to mechanical dispensing valve 190. In some embodiments, a first terminal end 147 of syrup supply line 148 is placed in fluid communication with a syrup storage container 640 and a second terminal end 149 is in fluid communication with mechanical dispensing valve 190.

The disclosure herein is not limited to embodiments having a single base liquid storage container and/or a single syrup storage container, and non-electric beverage dispensers described herein may include any number of base liquid storage containers and syrup storage containers.

Figure 5:
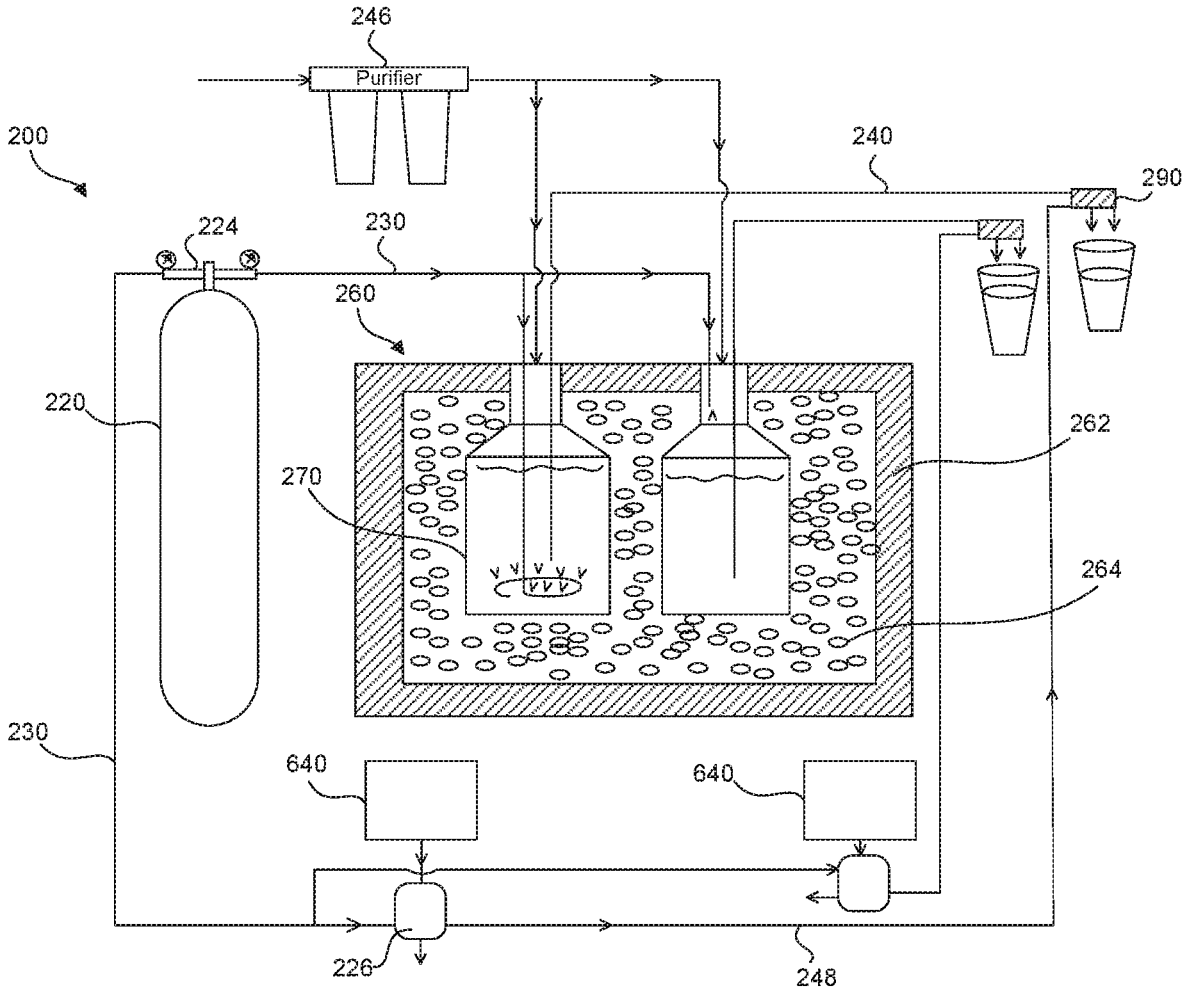
FIG. 5 shows a diagram of the components of a non-electric fountain beverage dispenser according to some embodiments.

Embodiments of non-electric beverage dispenser 100 may have two or more base liquid storage containers and can be used with two or more syrup storage containers, as shown for example in FIG. 5. The use of two or more base liquid storage containers 270 enables non-electric fountain beverage dispenser 200 to dispense two or more types of base liquids. In an embodiment in which two base liquid storage containers 270 are used, a first base liquid storage container may contain water, and a second base liquid storage container may container carbonated water. Alternately, the use of additional base liquid storage containers may simply serve to provide additional storage of a single base liquid. In some embodiments, each base liquid storage container 270 may be in fluid communication with a water purifier 246, as described above, for providing purified or filtered water to each base liquid storage container 270.

Each base liquid storage container 270 may be in fluid communication with a gas container 220, such as by means of a gas supply line 230, for driving fluid flow through beverage dispenser 200. Further, in some embodiments, gas supply line 230 may be used to carbonate the base liquid within at least one of base liquid storage containers 270. Gas container 220 may include a pressure regulator 224 for regulating a pressure of the pressurized gas supplied to base liquid storage containers 270.

Non-electric beverage dispenser 200 may also have two or more syrup storage containers 640, as shown for example in FIG. 5. Each syrup storage container 640 may include a different type of syrup for producing a different type of beverage.

Each syrup storage container 640 may also be in fluid communication with gas container 220 for driving a flow of syrup, such as by means of a gas supply line 230. A separate gas supply line 230 may be provided for each syrup storage container 640, or alternatively, a single gas supply line 230 may be branched so as to supply pressurized gas to two or more syrup storage containers 640. Gas container 220 may have a secondary pressure regulator 226 for regulating a pressure of the pressurized gas supplied to syrup storage containers 640. By adjusting the pressure of the pressurized gas supplied to base liquid storage containers 270 and syrup storage containers 640, the ratio of base liquid to syrup dispensing by mechanical dispensing valves 290 can be adjusted.

Non-electric fountain beverage dispenser 200 includes a plurality of mechanical dispensing valves 290 as described above. Each mechanical dispensing valve 290 is in fluid communication with a base liquid storage container 270 and a syrup storage container 640 so as to be able to dispense a mixture of a base liquid and a syrup. Each mechanical dispensing valve 290 may be used to dispense a different beverage. Each syrup storage container 640 is in fluid communication with a mechanical dispensing valve 290, such as by means of a syrup supply line 248. In some embodiments, each syrup storage container 640 is in fluid communication with a different mechanical dispensing valve 290. Each base liquid storage container 270 is in fluid communication with at least one mechanical dispensing valve 290, such as by means of a base liquid supply line 240. In embodiments in which two or more base liquid storage containers 270 are used to store different base liquids, a first base liquid storage container 270 may store water and may be in fluid communication with one or more mechanical dispensing valves 290 configured to dispense water-based beverages, such as lemonade, iced tea, or sports drinks, and the second base liquid storage container 270 may store carbonated water and may be in fluid communication with one or more mechanical dispensing valves 290 configured to dispense carbonated beverages, such as different types of soda.

Figure 6:
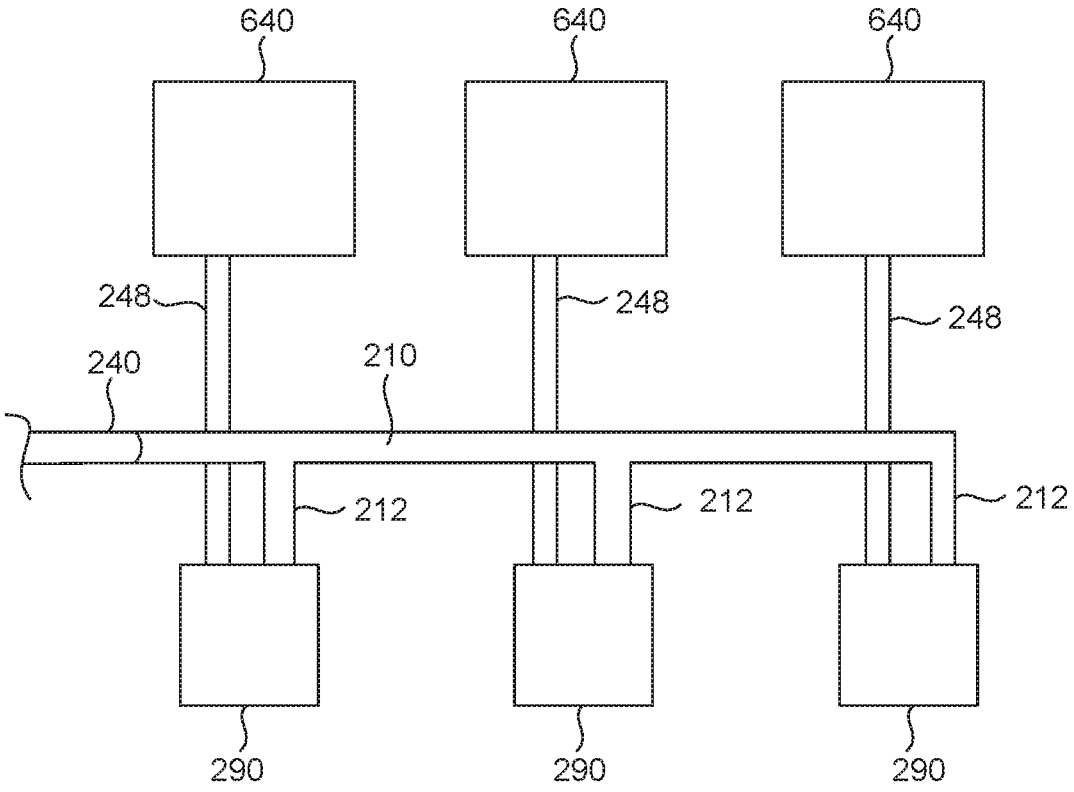
FIG. 6 shows a diagram of the mechanical dispensing valves of a non-electric fountain beverage dispenser according to some embodiments.

In embodiments, non-electric beverage dispenser further includes a manifold 210 for distributing the base liquid to a plurality of mechanical dispensing valves 290. A base liquid supply line 240 may be integrally formed with or may be connected to manifold 210, as shown for example at FIG. 6. Manifold 210 is configured to communicate the base liquid supplied from a base liquid storage container 270 to a plurality of mechanical dispensing valves 290. Thus, manifold 210 provides base liquid supply line 240 with a plurality of outlets 212 that can each be connected to a different mechanical dispensing valve 290. In such embodiments, each mechanical dispensing valve 190 may be in fluid communication with a single syrup storage container 640 by means of individual syrup supply lines 248. In this way, each mechanical dispensing valve 290 is in fluid communication with a base liquid storage container and a syrup storage container 640 so as to selectively dispense a mixture of the base liquid and the syrup.

In some embodiments, non-electric beverage dispensers as described herein may further include a non-electric cooling unit 160 configured to reduce the temperature of the base liquid (e.g., cool the base liquid) without the use of electricity. Non-electric cooling unit 160 is configured to cool the base liquid prior to the dispensing of the base liquid. In some embodiments, non-electric cooling unit 160 is also configured to cool the syrup prior to the dispensing of the syrup. Non-electric cooling unit 160 may cool the base liquid and the syrup as the base liquid and syrup flow through base liquid supply line 140 and syrup supply line 148, respectively. In some embodiments, non-electric cooling unit 160 may be configured to reduce the temperature of the base liquid, and optionally the syrup, to a temperature of about 32° F. to about 60° F., about 33° F. to about 50° F., or about 35° F. to about 45° F.

Figure 7:
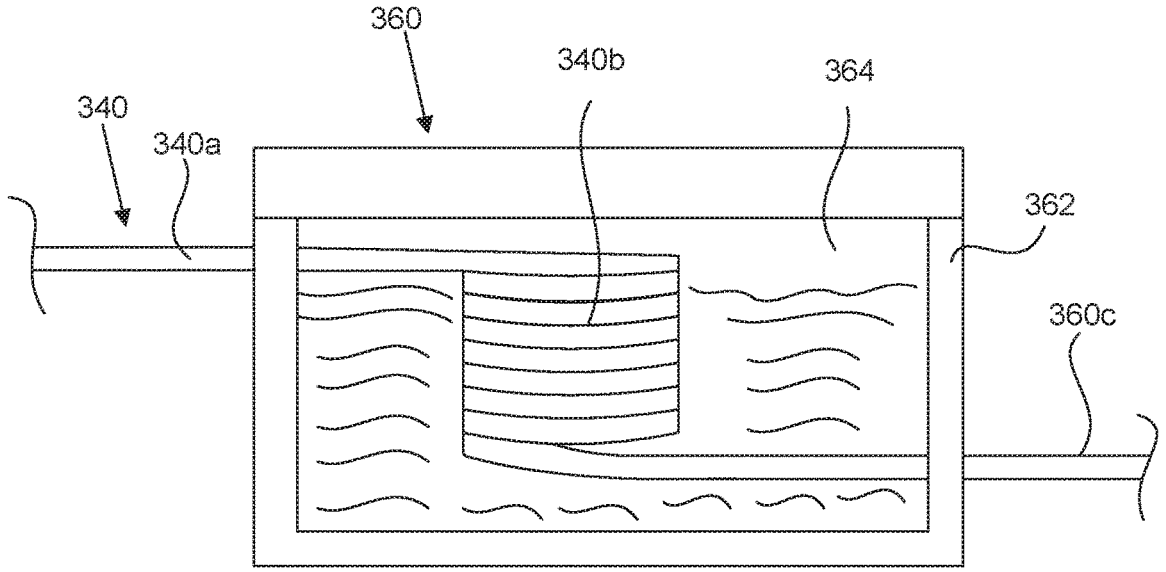
FIG. 7 shows a longitudinal cross-sectional view of a non-electric cooling unit of a non-electric fountain beverage dispenser according to some embodiments.

In some embodiments, a non-electric cooling unit may include an insulated container, as shown for example in FIG. 7. Insulated container 362 includes an interior volume 364 configured to store a quantity of ice that is used to cool the base liquid and/or syrup. While the present application refers primarily to ice, it is understood that interior volume 364 of insulated container 362 can be used to hold and store any material capable of cooling the base liquid and/or syrup, such as a liquid material (e.g., water), a solid material (e.g., ice), or a mixture thereof. Insulated container 362 may have any of various configurations, and may be formed substantially as a cube or a rectangular prism. In order to inhibit heat transfer into the insulated container 362, insulated container 362 may be formed from a material with a low thermal conductivity, insulated container 362 may be formed of a double-walled construction, and/or insulated container 362 may include one or more layers of a thermally insulating material.

In some embodiments, base liquid supply line 340 extends through interior volume 364 of insulated container 362 such that base liquid supply line 340 is in contact with the ice therein. In such embodiments, a portion 340*b* of the base liquid supply line 340 within interior volume 364 of insulated container 362 may be coiled to enable a longer length of base liquid supply line 340 to be positioned within interior volume 364 of insulated container 262, which allows a greater quantity of the base liquid to be cooled and increases the amount of time the base liquid spends within insulated container 362. Base liquid supply line 340 may be a single, continuous supply line extending from a base liquid storage container, through insulated container 362 of non-electric cooling unit 360, and connecting to a mechanical dispensing valve. In alternate embodiments, base liquid supply line 340 may be composed of one or more separate portions that are in fluid communication with one another, such as a first portion 340*a* that supplies base liquid to non-electric cooling unit 360 and which is in fluid communication with a second portion 340*b* within insulated container 362, which is in turn in fluid communication with a third portion 340*c* that supplies the cooled base liquid from non-electric cooling unit 360 to a mechanical dispensing valve. Further, the portion 340*b* of base liquid supply line 340 within insulated container 362 may be integrally formed with non-electric cooling unit 360 or may be removably positioned therein.

Figure 8:
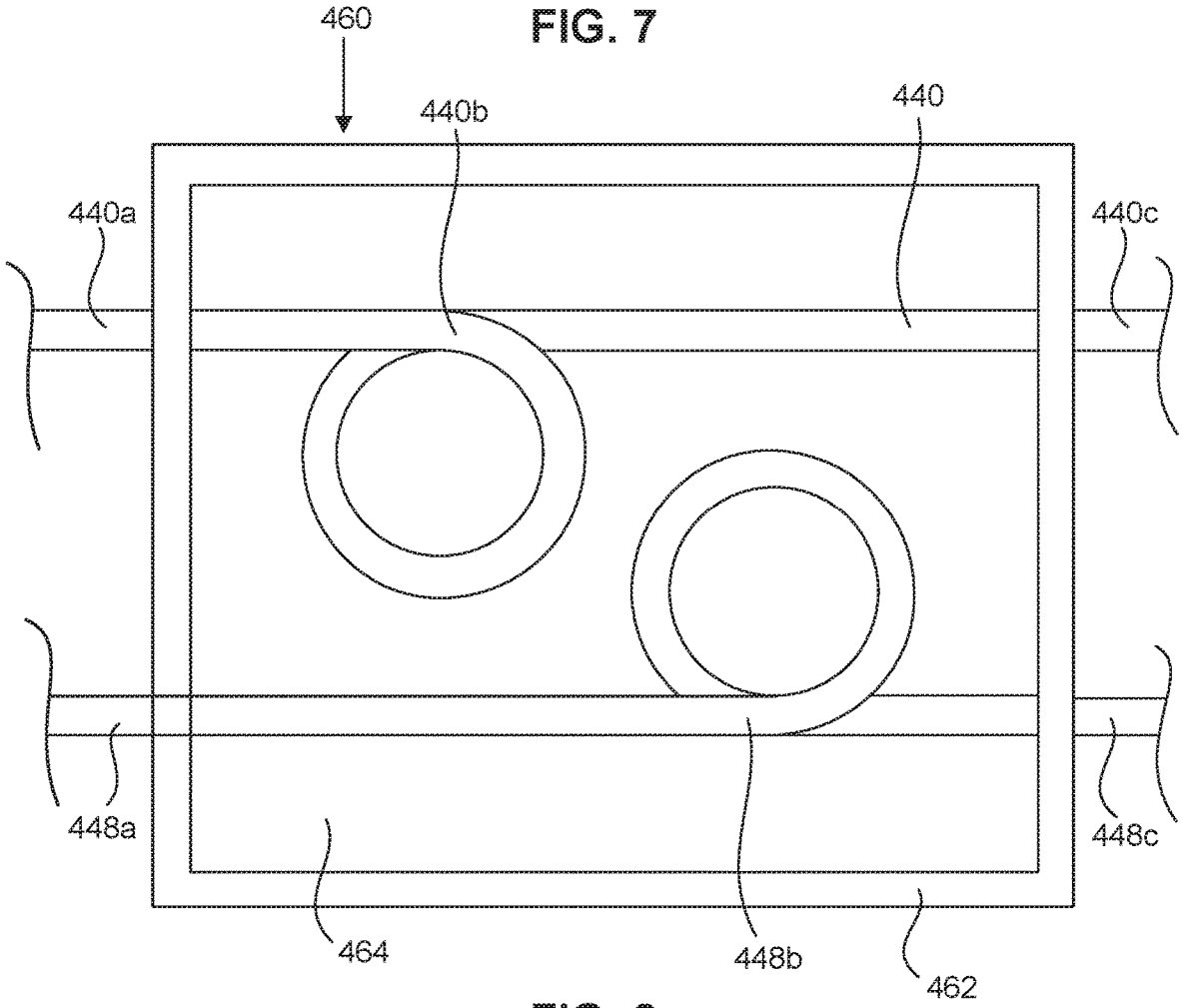
FIG. 8 shows a top-down view of a non-electric cooling unit of a non-electric fountain beverage dispenser according to some embodiments.

In some embodiments, as shown in FIG. 8, a base liquid supply line 440 extends through an interior volume 464 of insulated container 462 of non-electric cooling unit 460, and additionally a syrup supply line 448 extends through interior volume 464 of insulated container 462 such that syrup supply line 448 is in contact with the ice therein. In such embodiments, a portion 448*b* of syrup supply line 448 within interior volume 464 of insulated container 462 may be coiled so that a longer length of syrup supply line 448 is able to be positioned within interior volume 464 of insulated container 462. As discussed above with respect to the form of the base liquid supply line 440, syrup supply line 448 may be a single, continuous line or may similarly be formed of multiple portions 448*a*, 448*b*, 448*c* in fluid communication with one another.

In some embodiments, as shown for example in FIG. 5, non-electric cooling unit 260 includes an insulated container 262 having an interior volume 264 for storing ice, and rather than passing supply lines through insulated container 262, base liquid storage container 270 is placed within interior volume 264 of insulated container 262 such that base liquid storage container 270 is in contact with ice stored in insulated container 262. In this way, the entire base liquid storage container 270 and base liquid therein may be cooled by non-electric cooling unit 260. Base liquid storage container 270 may be removably positioned within insulated container 262 or may be integrally formed therewith. Such an arrangement also conserves space by positioning base liquid storage container 270 within non-electric cooling unit 260.

Figure 9:
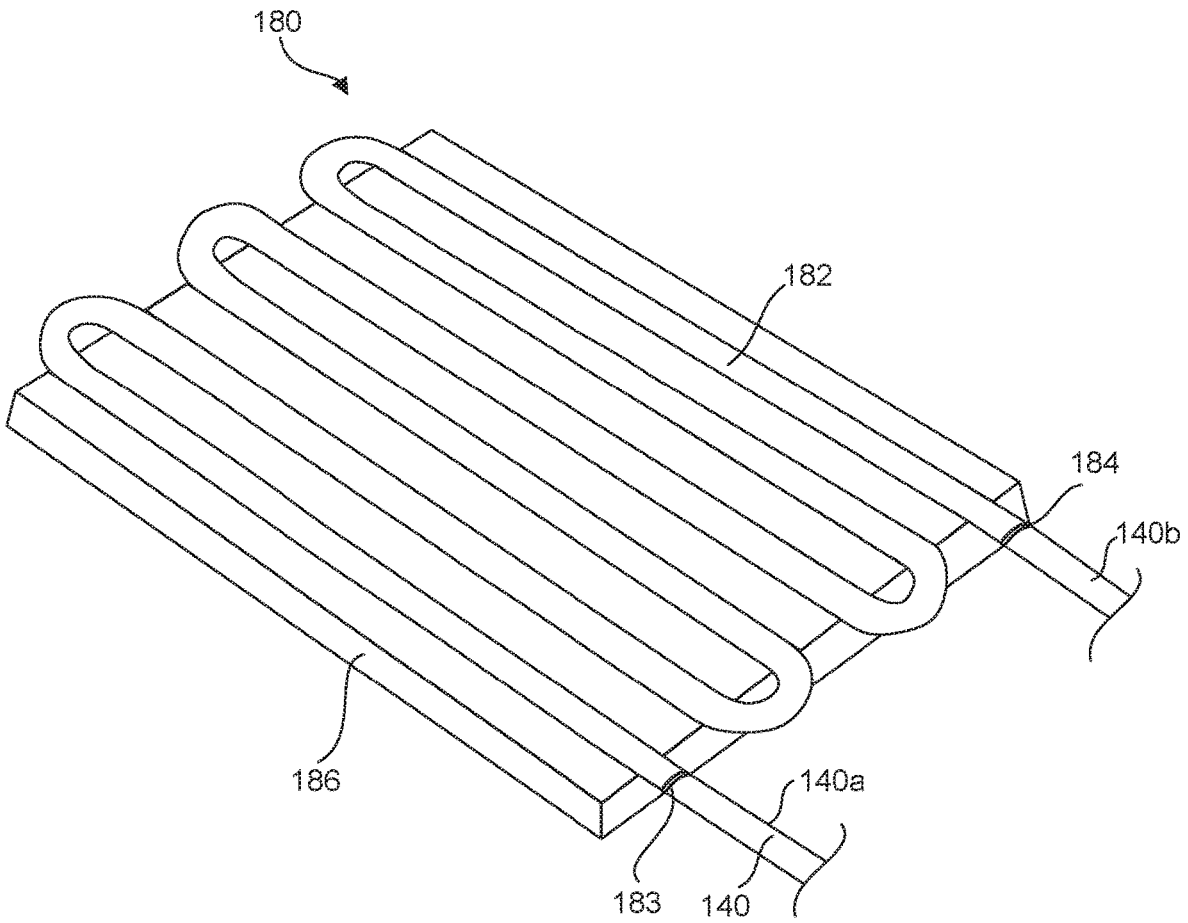
FIG. 9 shows a perspective view of a cold plate of a non-electric fountain beverage dispenser according to some embodiments.

In some embodiments, non-electric cooling unit includes an insulated container having an interior volume for storing ice as described above with respect to FIGS. 7-8, and which further includes a cold plate 180, as shown in FIG. 9. Cold plate 180 includes a substrate 186 that supports a conduit 182. Conduit 182 may have a serpentine configuration and is arranged so that conduit 182 is in a substantially planar arrangement on substrate 186. Cold plate 180 is inserted into interior volume of insulated container so that the ice therein can cool cold plate 180 and in turn the base liquid or syrup flowing through conduit 182 of cold plate 180. Conduit 182 of cold plate 180 may include an inlet 183 and an outlet 184 for connection to base liquid supply line 140 or syrup supply line 148. In this way, the base liquid may flow from base liquid storage container 170, through base liquid supply line 140, through conduit 182 of cold plate 180, and to mechanical dispensing valve 190. As discussed above, base liquid supply line 140 may be a continuous supply line such that a portion of base liquid supply line 140 serves as conduit 182 of cold plate 180, or base liquid supply line 140 may include multiple separate portions that are in fluid communication with one another, such as a first portion 140*a* that supplies base liquid to an inlet 183 of conduit 182, conduit 182 of the cold plate 180, and a second portion 140*b* connected to an outlet 184 of conduit 182. In embodiments in which the base liquid and the syrup are desired to be cooled, a separate cold plate 180 may be provided for cooling the syrup in syrup supply line 148 in the same manner as described with respect to the base liquid.

In any embodiment of non-electric cooling unit described herein, non-electric cooling unit may be positioned within housing of non-electric fountain beverage dispenser. Thus, in some embodiments, housing 150 contains at least base liquid storage container 170 and non-electric cooling unit 160. Further, gas supply line 130, base liquid supply line 140, and syrup supply line 148 may be at least partially contained within housing 150.

Figure 10:
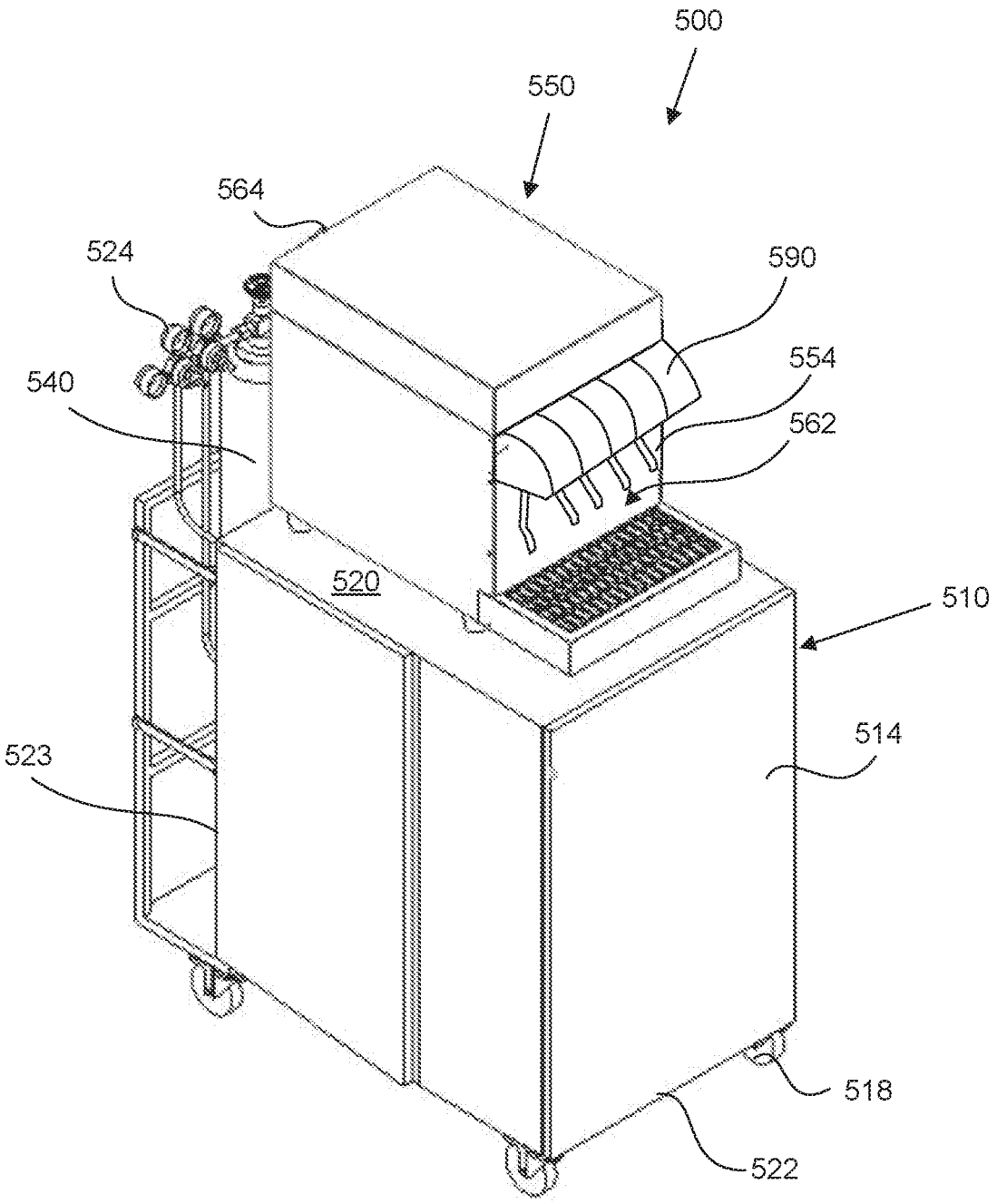
FIG. 10 shows a perspective view of a non-electric fountain beverage dispensing system according to some embodiments.
Figure 11:
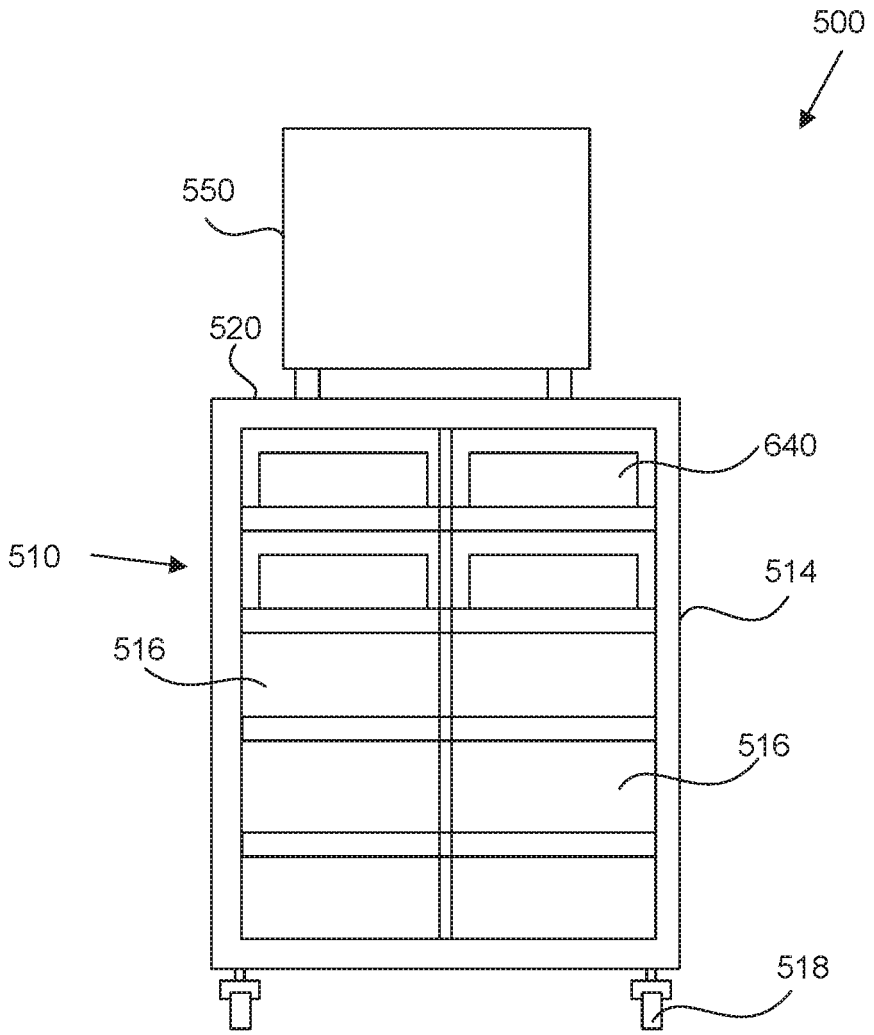
FIG. 11 shows a rear view of a non-electric fountain beverage dispensing system according to some embodiments.

Some embodiments relate to a non-electric fountain beverage dispensing system that includes a non-electric fountain beverage dispenser as described herein, and a movable cart 510. FIGS. 10-11 show views of a non-electric fountain beverage dispensing system 500 that includes a non-electric fountain beverage dispenser 550 and a movable cart 510. Movable cart 510 may also be non-electric and does not include electrical components and does not require electricity. Movable cart 510 may include a frame 514 having a front portion 522 and a rear portion 523. Frame 514 may be shaped substantially as a cube or rectangular prism, among any of various other shapes. Frame 514 includes a mounting surface 520 at an upper end thereof on which non-electric fountain beverage dispenser 550 can be positioned. Mounting surface 520 may be substantially planar so as to provide a flat, level surface on which non-electric fountain beverage dispenser 550 can be positioned.

Movable cart 510 further includes at least one storage compartment 516 (as best shown in FIG. 11) for storing a syrup storage container 640. Frame 514 may define a plurality of storage compartments 516 each configured to receive a single syrup storage container 640, such that frame 514 may store two or more, four or more, six or more, eight or more, or ten or more syrup storage containers 640. Storage compartments 516 may be accessible from a rear portion 523 of movable cart 510. In some embodiments, each storage compartment 516 may have a substantially square or rectangular shape. Storage compartments 516 may be arranged in one or more rows and columns, for example in a 2x2, 2x3, 2x4, 2x5, 3x3, 3x4, 3x5, 4x4 or 4x5 layout, among other layouts. The storage compartments 516 may be specifically configured to receive bag-in-a-box type syrup storage containers 640. Each syrup storage container 640 may be a bag-in-a-box ("BiB"), in which a bag containing a syrup is stored within a rigid or semi-rigid box and the syrup can escape from the interior of the box via a port or nozzle on the box.

In some embodiments, movable cart 510 further includes a plurality of wheels 518 that allow movable cart 510 to roll on a surface, such as on a floor or on the ground. The wheels may be caster wheels. In FIG. 10, movable cart 510 is shown as having four wheels 518, however, in alternate embodiments, movable cart 510 may have additional or fewer wheels 518.

Movable cart 510 may further be configured to secure and support a gas container 540. Movable cart 510 may include a holder for gas container 540 at a rear portion 523 of frame 514. Gas container 540 is accessible by an operator, such as for monitoring and adjusting pressure regulator 524 as necessary for supplying pressurized gas from gas container 540 to a base liquid storage container and syrup storage container(s) 640.

Beverage dispenser 550 may be positioned on mounting surface 520 of movable cart 510 such that a front portion 554 of beverage dispenser 550 having mechanical dispensing valves 590 is oriented towards front portion 522 of movable cart 510 and a rear portion 564 is oriented towards rear portion 523 of movable cart 510. Gas container 540 may be positioned at rear portion 523 of movable cart 510, and syrup storage containers 640 are located within storage compartments 516 at rear portion 523 of movable cart 510. In this way, front portion 522 of movable cart 510 presents a consumer with mechanical dispensing valves 590 and beverage dispensing area 562 of beverage dispenser 550. Components of beverage dispenser 550, such as gas container 540, syrup storage containers 640 and supply lines are located at rear portion 523 of movable cart 510 such that they are at least partially hidden and out of sight of the consumer. Further, such operating components are located at rear portions 523, 564 of movable cart 510 and beverage dispenser 550 for convenient access by an operator.

The non-electric fountain beverage dispensers described herein provide consumers with the same or similar beverage dispensing experience as conventional fountain beverage dispenser, but without the use of electricity. The non-electric fountain beverage dispensers may include one or more mechanical dispensing valves positioned on a front portion of a beverage dispenser housing so as to define a beverage dispensing area, and the mechanical dispensing valves are accessible by the consumer. Each mechanical dispensing valve may correspond to a particular type or style of beverage. The consumer can select a desired beverage among the available options, position a beverage container, such as a cup, beneath a mechanical dispensing valve corresponding to the desired beverage, and manually actuate a mechanical actuator of the mechanical dispensing valve to dispense the beverage. As the mechanical actuator is actuated, the mechanical dispensing valve dispenses a mixture of a base liquid and a syrup.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

The breadth and scope of the present invention(s) should not be limited by any of the above-described exemplary embodiments, but should be defined only in accordance with the following claims and their equivalents.

What is claimed is:

1. A non-electric, fountain beverage dispenser, comprising:

a gas container configured to store a pressurized gas;

a base liquid storage container configured to store a base liquid;

a gas supply line in fluid communication with the gas container, wherein the gas supply line communicates the pressurized gas from the gas container to the base liquid storage container, and wherein the gas supply line is configured to communicate the pressurized gas from the gas container to a syrup storage container containing a syrup;

a base liquid supply line having a first terminal end in fluid communication with the base liquid storage container, and a second terminal end;

a syrup supply line having a first terminal end in fluid communication with the syrup storage container, and a second terminal end;

a non-electric cooling unit configured to cool the base liquid without the use of electricity, wherein the base liquid storage container is arranged within the non-electric cooling unit; and a mechanical dispensing valve fixedly mounted on an exterior surface of the fountain beverage dispenser, the mechanical dispensing valve in fluid communication with the second terminal end of the base liquid supply line and the second terminal end of the syrup supply line such that the mechanical dispensing valve is configured to be mechanically actuated for selectively dispensing a mixture of the base liquid and the syrup.

2. The beverage dispenser of claim 1, wherein the pressurized gas is carbon dioxide.

3. The beverage dispenser of claim 2, wherein the base liquid within the base liquid storage container is carbonated by the carbon dioxide supplied to the base liquid storage container via the gas supply line.

4. The beverage dispenser of claim 1, wherein the gas container further comprises a pressure regulator configured to regulate a pressure of the pressurized gas supplied to the base liquid storage container.

5. The beverage dispenser of claim 4, further comprising a secondary pressure regulator configured to regulate a pressure of the pressurized gas supplied to the syrup storage container.

6. The beverage dispenser of claim 1, further comprising a water purifier in fluid communication with the base liquid storage container.

7. The beverage dispenser of claim 1, further comprising a secondary base liquid storage container, wherein the secondary base liquid storage container is configured to store a second base liquid.

8. The beverage dispenser of claim 1, wherein the non-electric cooling unit comprises an insulated container having an interior volume configured to store ice, and wherein the base liquid supply line extends through the interior volume of the insulated container.

9. The beverage dispenser of claim 8, wherein a portion of the base liquid supply line that extends through the insulated container is coiled.

10. The beverage dispenser of claim 1, wherein the non-electric cooling unit is further configured to cool syrup in the syrup supply line.

11. The beverage dispenser of claim 1, wherein the non-electric cooling unit comprises:

an insulated container having an interior volume configured to store ice, and a cold plate disposed within the interior volume of the insulated container and which is in fluid communication with the base liquid supply line.

12. The beverage dispenser of claim 1, wherein the syrup supply line is one of a plurality of syrup supply lines, and the mechanical dispensing valve is one of a plurality of mechanical dispensing valves, and wherein each of the plurality of syrup supply lines comprises a first terminal end in fluid communication with a syrup storage container and a second terminal end in fluid communication with a mechanical dispensing valve of the plurality of mechanical dispensing valves.

13. The beverage dispenser of claim 1, wherein the mechanical dispensing valve is one of a plurality of mechanical dispensing valves, and the base liquid supply line comprises a manifold configured to direct the base liquid to the plurality of mechanical dispensing valves.

14. The beverage dispenser of claim 1, wherein the mechanical dispensing valve comprises a mechanical actuator that, when actuated, causes the mechanical dispensing valve to dispense the mixture of the base liquid and the syrup.

15. A non-electric fountain beverage dispenser, comprising:

a gas container configured to store a pressurized gas;

a housing containing a base liquid storage container configured to store a base liquid, and a non-electric cooling unit configured to cool the base liquid, wherein the non-electric cooling unit comprises an insulated container configured to be filled with ice, and wherein the base liquid storage container is arranged within the insulated container;

wherein the gas container is in fluid communication with the base liquid storage container so as to supply the pressurized gas to the base liquid storage container for driving a flow of the base liquid, and wherein the gas container is configured to be placed in fluid communication with a syrup storage container so as to supply the pressurized gas to the syrup storage container for driving a flow of the syrup, the flow of the syrup flowing through the non-electric cooling unit; and a mechanical dispensing valve in fluid communication with the base liquid storage container and the syrup storage container such that the mechanical dispensing valve is configured to selectively dispense a mixture of the base liquid and the syrup.

16. The beverage dispenser of claim 15, further comprising a base liquid supply line for communicating the base liquid from the base liquid storage container to the mechanical dispensing valve, wherein the base liquid supply line is contained within the housing.

17. The beverage dispenser of claim 16, wherein the mechanical dispensing valve is mounted on an exterior surface of the housing so as to define a beverage dispensing area beneath the mechanical dispensing valve.

18. The beverage dispenser of claim 17, further comprising a drip tray connected to the housing and positioned in the beverage dispensing area beneath the mechanical dispensing valve.

19. A beverage dispensing system, comprising:

a non-electric fountain beverage dispenser, comprising:

a gas container configured to store a pressurized gas;

a housing containing a base liquid storage container configured to store a base liquid;

a gas supply line in fluid communication with the gas container, wherein the gas supply line communicates the pressurized gas from the gas container to the base liquid storage container, and wherein the gas supply line is configured to communicate the pressurized gas from the gas container to a syrup storage container containing a syrup;

a base liquid supply line having a first terminal end in fluid communication with the base liquid storage container, and a second terminal end;

a syrup supply line having a first terminal end configured to be placed in fluid communication with the syrup storage container, and a second terminal end;

a non-electric cooling unit configured to cool the base liquid without the use of electricity; and a mechanical dispensing valve fixedly mounted on an exterior surface of the housing, the mechanical dispensing valve connected to the second terminal end of the base liquid supply line and the second terminal end of the syrup supply line such that the mechanical dispensing valve is configured to be mechanically actuated for selectively dispensing a mixture of the base liquid and the syrup;

a movable cart comprising a frame having a support surface on which the non-electric fountain beverage dispenser is positioned, and a storage compartment configured to store the syrup storage container.

20. The beverage dispensing system of claim 19, wherein the movable cart further comprises a plurality of wheels.

* * * * *